US005771850A

United States Patent [19]

Okada

[11] Patent Number: 5,771,850

[45] Date of Patent: Jun. 30, 1998

[54] CYLINDER HEAD COVER HAVING A WIRING PORTION

[75] Inventor: Kunio Okada, Toyota, Japan

[73] Assignee: Toyota Jidosha Kabushiki Kaisha, Toyota, Japan

[21] Appl. No.: 861,085

[22] Filed: May 21, 1997

[30] Foreign Application Priority Data

May 23, 1996 [JP] Japan ..... 8-128086

[51] Int. Cl.[6] ..... F02P 23/00

[52] U.S. Cl. ..... 123/143 C

[58] Field of Search ..... 123/143 C, 169 PA, 123/647, 635, 636, 655, 169 PH; 339/26; 174/72 A

[56] References Cited

U.S. PATENT DOCUMENTS

| | | | |
|---|---|---|---|
| 4,706,639 | 11/1987 | Boyer et al. | 123/647 |
| 5,179,919 | 1/1993 | Foltz, Jr. et al. | 123/143 C |
| 5,218,936 | 6/1993 | Pritz et al. | 123/143 C |
| 5,323,740 | 6/1994 | Daily et al. | 123/90.38 |

FOREIGN PATENT DOCUMENTS

| | | | |
|---|---|---|---|
| 62-51296 | 3/1987 | Japan | 123/143 C |
| 62-90957 | 6/1987 | Japan | 123/143 C |
| 6-50171 | 2/1994 | Japan | 123/143 C |
| 6-73384 | 10/1994 | Japan | 123/143 C |

*Primary Examiner*—Raymond A. Nelli
*Attorney, Agent, or Firm*—Oblon, Spivak, McClelland, Maier & Neustadt, P.C.

[57] ABSTRACT

A cylinder head cover for an internal combustion engine includes a plurality of contacts to which electronic parts of the engine are electrically connected. A control-unit connector has terminals to which an electronic control unit of the engine is electrically connected. A wiring portion has electric connections for interconnecting the contacts and the terminals of the control-unit connector, the wiring portion being integral with a wall of the cylinder head cover.

10 Claims, 8 Drawing Sheets

CYLINDER HEAD COVER HAVING A WIRING PORTION

BACKGROUND OF THE INVENTION (1) Field of the Invention

The present invention relates to a cylinder head cover which is appropriate for use in an internal combustion engine provided with a plurality of electronic parts and an electronic control unit.

(2) Description of the Related Art

In an internal combustion engine of an automotive vehicle, electronic controlled systems, such as a fuel injection control system and a spark timing control system, are installed with an electronic control unit, and these systems are controlled by the electronic control unit. In order to carry out the electronic control of these systems by the electronic control unit in accordance with an operation of the engine, it is essentially necessary to provide the engine with various electronic parts and make electric connections between the electronic parts and the electronic control unit.

The electronic parts which must be attached to the engine include various electronic sensors for sensing the operating condition of the engine, and various actuators and drive circuits for executing electronic control operations of the electronic controlled systems.

FIG. 1 shows a plurality of electronic parts installed around a cylinder head cover of a conventional engine, and a wiring harness used to interconnect the electronic parts and an electronic control unit (not shown).

As shown in FIG. 1, the conventional engine 10 is provided with the electronic parts in order for sensing the operating condition of the engine. The electronic parts include: an intake air temperature sensor 12, a throttle position sensor 14, a vacuum sensor 16, an oxygen sensor 18, an oil pressure sensor 20, and a water temperature sensor 22. The conventional engine 10 is provided with actuators and drive circuits in order for executing the electronic control operations of the electronic controlled systems. The actuators and drive circuits include: a resistor unit 24, a plurality of fuel injectors 26-1 through 26-4, a water temperature switch 28, an ignitor 30, and an alternator 32.

Further, in the conventional engine 10, a wiring harness 34 which is indicated by thick lines in FIG. 1 is provided. The wiring harness 34 is used to interconnect the electronic parts and the electronic control unit (not shown). The wiring harness 34 has various connectors at ends of its branch lines. When installing the wiring harness 34 and the electronic parts around the cylinder head cover of the conventional engine 10, the connectors of the wiring harness 34 are attached to the electronic parts.

As shown in FIG. 1, the wiring harness 34 further includes a connector 36 and a connector 38. The connectors 36 and 38 are attached to the electronic control unit (not shown) in order to electrically connect the electronic control unit to the electronic parts by the wiring harness 34.

In the conventional engine 10, the wiring harness 34 has a complicated structure, and it is very difficult to perform the routing of the wiring harness 34 around the cylinder head cover of the conventional engine 10 while the connectors of the wiring harness 34 are attached to the electronic parts and the connectors 36 and 38 are attached to the electronic control unit.

Generally, in the conventional engine 10, connecting operations between the wiring harness connectors and the electronic parts, connecting operations between the connectors 36 and 38 and the electronic control unit, and the routing of the wiring harness 34 around the cylinder head cover of the engine must be manually performed. Since the wiring harness 34 has a complicated structure, assembly workers must perform the connecting operations and the routing of the wiring harness 34 in various installing directions of the conventional engine 10.

More specifically, the connecting operations between the wiring harness connectors and the electronic parts and the routing of the wiring harness 34 are performed after the conventional engine 10 and other components are placed into an engine room of the automotive vehicle. Under such circumstances, the assembly workers must perform the connecting operations in narrow working areas of the engine room of the vehicle. In a certain case, the assembly workers must extend their hands or fingers to the narrow working areas to carry out the connecting operations.

Therefore, in a case of the conventional engine 10 utilizing the wiring harness 34 having the complicated structure, it is difficult to provide a good operability of the electric connections between the electronic parts and the electronic control unit in the vehicle assembly. The conventional engine 10 has a problem in that the electric connections between the electronic parts and the electronic control unit are based upon the wiring harness 34 having the complicated structure. As described above, since the connecting operations must be performed in the narrow working areas of the vehicle during assembly, it is difficult to ensure proper electric connections between the wiring harness connectors and the electronic parts and proper electric connections between the wiring harness connectors and the electronic control unit. The electric connections between the wiring harness connectors and the electronic parts in the conventional engine 10 are likely to be incomplete due to the poor operability of the vehicle assembly.

Further, in the conventional engine 10, the routing of the wiring harness 34 around the cylinder head cover while the wiring harness connectors are attached to the electronic parts as well as the electronic control unit is difficult to perform. When a break in a cable of the wiring harness 34 or a defective electric connection in the conventional engine 10 takes place, it is difficult to find out the location of such a defect in the engine. Therefore, in the case of the conventional engine 10, it is difficult to promptly discover a defect in the engine which is caused by a break of the wiring harness 34 or a defective electric connection.

Recently, there is a demand for an internal combustion engine provided with a larger number of electronic parts and a higher level of the control accuracy. Taking into account the above-described problems of the conventional engine 10 will be increasingly important as the number of the electronic parts to be installed around the cylinder head cover of the engine increases.

Japanese Laid-Open Utility Model Application No. 62-90957 discloses a structure of wiring harness connectors which electrically interconnect an electronic control unit (ECU) and electronic parts of an engine, which are installed in an engine room of an automotive vehicle.

By using the wiring harness connectors of the above-mentioned publication, it is possible to stably maintain the electric connections between the electronic parts and the ECU in the proper condition during an operation of the engine. The wiring harness connectors of the above-mentioned publication are effective to provide a reliability of the electric connections between the electronic parts and the ECU during the operation of the engine.

However, the structure of wiring harness connectors of the above-mentioned publication does not provide practical solutions to the problems of the conventional engine 10 when performing the routing of the wiring harness and the electric connections of the wiring harness connectors during the vehicle assembly. It is difficult that the structure of wiring harness connectors of the above-mentioned publication provide a good operability of the electric connections between the electronic parts and the ECU in the vehicle assembly and a good operability of the repair or maintenance of the vehicle for locating a defect in the engine.

SUMMARY OF THE INVENTION

A general object of the present invention is to provide an improved cylinder head cover in which the above-described problems are eliminated.

Another, more specific object of the present invention is to provide a cylinder head cover for an internal combustion engine which allows the electric connections between the electronic parts of the engine and the electronic control unit of the engine to be easily performed without using a wiring harness having a complicated structure.

Still another object of the present invention is to provide a cylinder head cover for an internal combustion engine which provides a good operability of the electric connections between the electronic parts and the electronic control unit in the vehicle assembly and a good operability of the repair or maintenance of the vehicle for locating a defect in the engine.

The above-mentioned objects of the present invention are achieved by a cylinder head cover for an internal combustion engine, which comprises: a plurality of contacts to which electronic parts of the engine are electrically connected; a control-unit connector which has terminals to which an electronic control unit of the engine is electrically connected; and a wiring portion which has electric connections for interconnecting the contacts and the terminals of the control-unit connector, the wiring portion being integral with a wall of the cylinder head cover.

By using the cylinder head cover of the present invention, the electronic parts can be easily connected to the contacts of the cylinder head cover, and the electronic control unit can be easily connected to the control-unit connector of the cylinder head cover. The cylinder head cover of the present invention includes the wiring portion which electrically interconnects the contacts and the terminals of the control-unit connector. According to the cylinder head cover of the present invention, the electric connections between the electronic parts and the electronic control unit can be easily performed by the wiring portion, and the use of the wiring harness can be eliminated. Therefore, it is possible for the cylinder head cover of the present invention to provide a reduction of the cost, a good operability of the electric connections between the electronic parts and the electronic control unit in the vehicle assembly, and a good operability of the repair or maintenance of the vehicle for locating a defect in the engine.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 2:
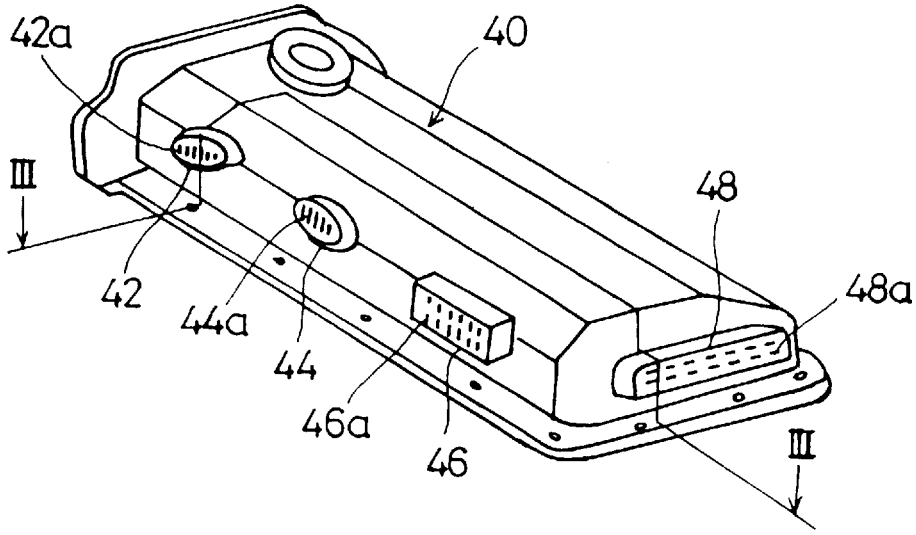
FIG. 2 is a perspective view of a cylinder head cover embodying the present invention.

FIG. 2 shows a cylinder head cover 40 embodying the present invention. The cylinder head cover 40 for use in an internal combustion engine is made of a heat resisting resin material.

As shown in FIG. 2, the cylinder head cover 40 has external connectors 42, 44 and 46 which are externally arranged on a side wall of the cylinder head cover 40, and a control-unit connector 48 which is externally arranged on an end wall of the cylinder head cover 40.

The connector 42, the connector 44 and the connector 46 on the side wall include a given number of terminals 42*a*, a given number of terminals 44*a* and a given number of terminals 46*a*, respectively. The control-unit connector 48 on the end wall includes a given number of terminals 48*a*.

Hereinafter, the terminals 42*a*, 44*a* and 46*a* of the external connectors 42, 44 and 46 will be called the contacts 42*a*, 44*a* and 46*a*, and the terminals 48*a* of the control-unit connector 48 will be called the terminals 48*a*, for the sake of convenience.

Figure 3:
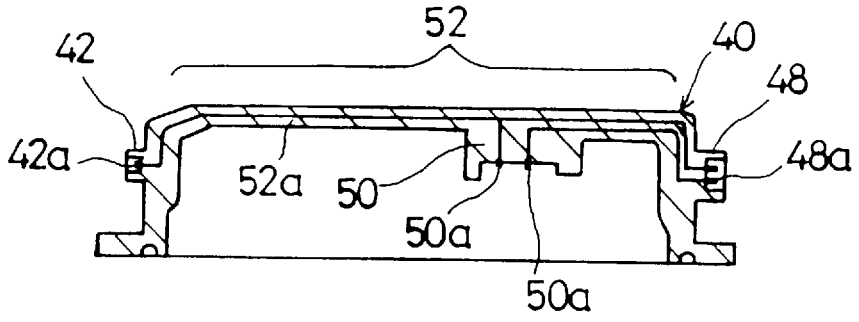
FIG. 3 is a cross-sectional view of the cylinder head cover taken along a line III—III indicated in FIG. 2.

FIG. 3 is a cross-sectional view of the cylinder head cover 40 taken along a line III—III indicated in FIG. 2.

As shown in FIG. 3, the cylinder head cover 40 of this embodiment includes an electronic-part fitting portion 50 which is internally arranged in the cylinder head cover 40. The electronic-part fitting portion 50 includes a given number of contacts 50*a* to which an internally arranged electronic part (not shown) is electrically connected. Further, the cylinder head cover 40 includes a wiring portion 52 which has electric connections 52*a* for interconnecting the externally arranged contacts 42*a*, 44*a* and 46*a*, the terminals 48*a* of the control-unit connector 48, and the internally arranged contacts 50*a*. The wiring portion 52 is integrally formed within a wall of the cylinder head cover 40. In the wiring portion 52, the electric connections 52*a* are formed by printed wire patterns or embedded metal conductors.

In the cylinder head cover 40 of the above-described embodiment, electronic parts installed around the cylinder head cover of the engine or electronic parts installed outside the engine, such as a crank angle sensor (not shown) and an oxygen sensor (not shown), are electrically connected to the contacts 42*a* and 44*a* of the external connectors 42 and 44. An electronic control unit (ECU) (not shown) of an electronic controlled transmission (ECT) installed outside the engine is electrically connected to the contacts 46*a* of the external connector 46. This electronic control unit (ECU) is used to control the ECT. An electronic part (not shown) internally arranged on the engine is electrically connected to the contacts 50*a* of the electronic-part fitting portion 50. Further, an electronic control unit (ECU) (not shown) of the engine is electrically connected to the terminals 48*a* of the control-unit connector 48. This electronic control unit (ECU) is used to carry out the electronic control of the systems such as the electronic the fuel injection control system and the spark timing control system in accordance with the operation of the engine.

Hereinafter, the electronic control unit of the engine will be called the engine ECU, and the electronic control unit of the ECT will be called the ECT ECU, for the sake of convenience.

Figure 1:
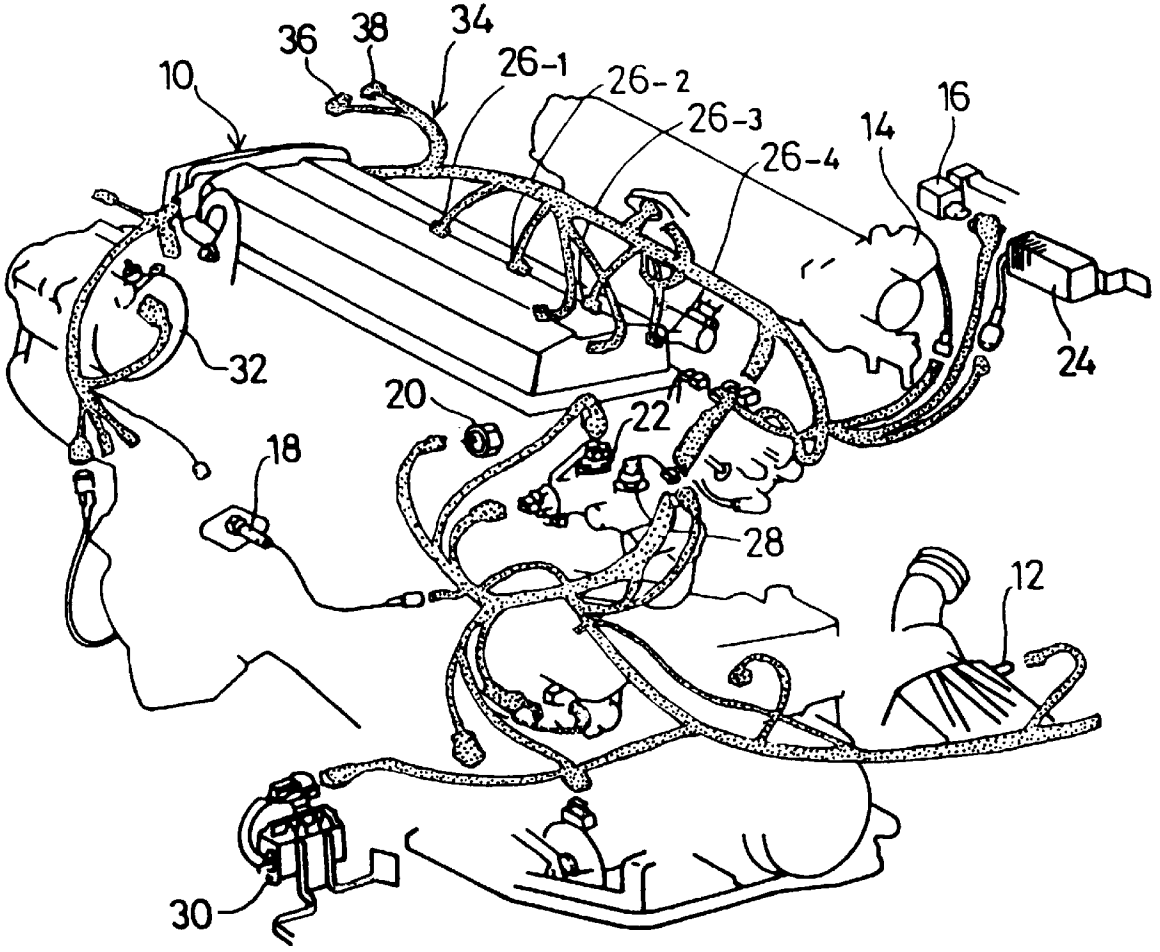
FIG. 1 PRIOR ART
FIG. 1 is a diagram showing a wiring harness of a conventional engine and a plurality of electronic parts around a cylinder head cover of the conventional engine.

In the cylinder head cover 40 of the above-described embodiment, the electric connections between the electronic parts (including the ECT ECU) and the engine ECU are made by the wiring portion 52 which is integrally formed within the wall of the cylinder head cover 40. By using the cylinder head cover 40, the electric connections between the electronic parts and the engine ECU can be easily performed, and the use of a wiring harness having a complicated structure as in the conventional engine 10 of FIG. 1 can be eliminated. Therefore, it is possible for the cylinder head cover of the present embodiment to provide a reduction of the cost, a good operability of the electric connections between the electronic parts and the electronic control unit in the vehicle assembly, and a good operability of the repair or maintenance of the vehicle.

Figure 4:
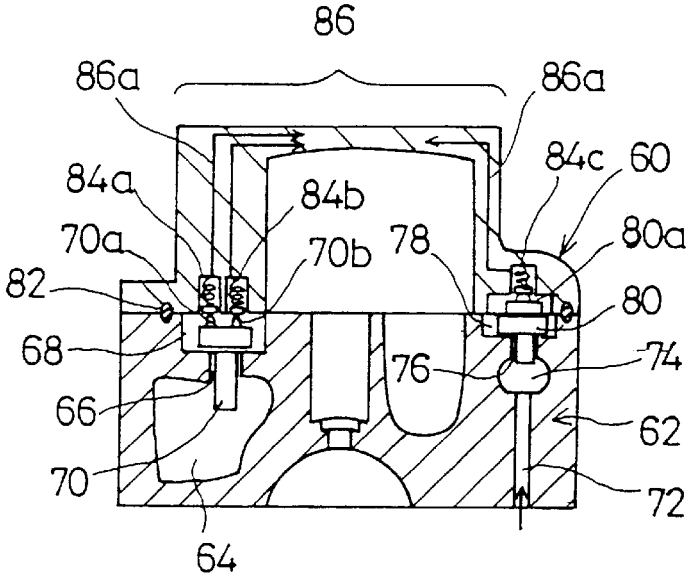
FIG. 4 is a cross-sectional view of a second embodiment of the cylinder head cover embodying the present invention.

FIG. 4 shows a second embodiment of the cylinder head cover embodying the present invention. In FIG. 4, a cross-section of a cylinder head cover 60 of this embodiment and a cylinder head 62 of an internal combustion engine is shown.

As shown in FIG. 4, the cylinder head 62 includes a water jacket 64 which is provided for the flow of an engine cooling water. The cylinder head 62 includes a through hole 66 which is open to the water jacket 64, and an opening 68 which is greater in diameter than the hole 66 and provided above the hole 66.

A water temperature sensor 70 having a sensing portion projecting into the water jacket 64 is arranged on the opening 68 and the hole 66 of the cylinder head 62. The water temperature sensor 70 has a terminal 70*a* and a terminal 70*b*. A signal indicative of a temperature (THW) of the engine cooling water in the water jacket 66 of the engine is produced by the water temperature sensor 70, and this signal is delivered between the terminal 70*a* and the terminal 70*b*.

Further, the cylinder head 62 includes an oil passage 72 which is provided for delivering a high-pressure engine oil from an oil pump (not shown) into the engine for lubrication. An oil hole 74 at the end of the oil passage 72 is formed. The cylinder head 62 includes a through hole 76 which is open to the oil hole 74, and an opening 78 which is greater in diameter than the hole 76 and provided above the hole 76.

An oil pressure switch 80 having a sensing portion projecting into the oil hole 74 is arranged on the opening 78 and the hole 76 of the cylinder head 62. The oil pressure switch 80 has a terminal 80*a*. An ON/OFF signal indicative of whether the pressure of oil in the oil hole 74 of the engine is above a reference pressure is produced by the oil pressure switch 80, and this signal is delivered on the terminal 80*a*.

The cylinder head cover 60 of this embodiment is made of a heat resisting resin material. The cylinder head cover 60 is bolted to an upper portion of the cylinder head 62. A sealing material 82 between the cylinder head cover 60 and the cylinder head 62 is provided to ensure sealing of the cylinder head cover 60 and the cylinder head 62.

The cylinder head cover 60 includes a spring contact 84*a* and a spring contact 84*b* which are electrically connected to the terminal 70*a* and the terminal 70*b* of the water temperature sensor 70, respectively, when the cylinder head cover 60 and the cylinder head 62 are properly connected to each other. Also, the cylinder head cover 60 includes a spring contact 84*c* which is brought into contact with the terminal 80*a* of the oil pressure switch 80. Each of the spring contacts 84*a*, 84*b* and 84*c* has a contact portion touching a corresponding one of the terminals 70*a*, 70*b* and 80*a*, and a spring portion pressing the contact portion onto the corresponding one of the terminals 70*a*, 70*b* and 80*a*.

Further, the cylinder head cover 60 includes a wiring portion 86 which has electric connections 86*a* for interconnecting the spring contacts 84*a*, 84*b* and 84*c* and terminals of a control-unit connector (not shown) on an end wall of the cylinder head cover 60. The wiring portion 86 is integrally formed within a wall of the cylinder head cover 60. In the wiring portion 86, the electric connections 86*a* are formed by printed wire patterns or embedded metal conductors.

Similarly to the control-unit connector 48 of FIG. 2, the control-unit connector of this embodiment is arranged on the end wall of the cylinder head cover 60, and includes a given number of terminals to which the engine ECU is electrically connected.

In the cylinder head cover 60 of the above-described embodiment, the electric connections between the electronic parts (such as the water temperature sensor 70 and the oil pressure switch 80) and the engine ECU are made by the wiring portion 86 which is formed within the wall of the cylinder head cover 60. By using the cylinder head cover 60, the electric connections between the electronic parts and the engine ECU can be easily performed, and the use of a wiring harness having a complicated structure as in the conventional engine 10 of FIG. 1 can be eliminated.

Figure 5:
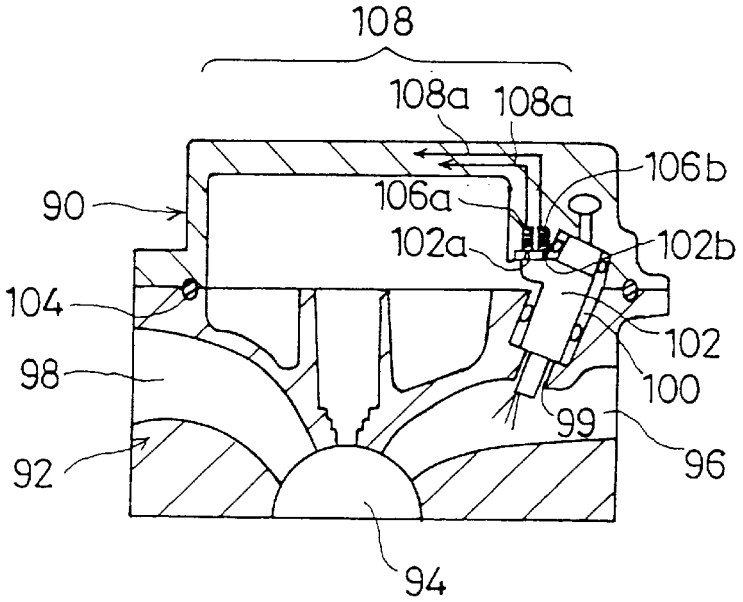
FIG. 5 is a cross-sectional view of a third embodiment of the cylinder head cover embodying the present invention.

FIG. 5 shows a third embodiment of the cylinder head cover embodying the present invention. In FIG. 5, a cross-section of a cylinder head cover 90 of this embodiment and a cylinder head 92 of an internal combustion engine is shown.

As shown in FIG. 5, the cylinder head 92 includes a combustion chamber 94 which is provided for one of a plurality of cylinders of the engine. The cylinder head 92 includes an intake port 96 and an exhaust port 98 which are open to the combustion chamber 94. The cylinder head 92 includes a through hole 99 which is open to the intake port 96, and an opening 100 which is greater in diameter than the hole 99 and provided above the hole 99.

A fuel injector 102 having a leading edge projecting into the intake port 96 is arranged on the opening 100 and the hole 99 of the cylinder head 92. The fuel injector 102 is a type of electronic fuel injection valve, and has an input terminal 102*a* and an input terminal 102*b*. When a drive signal from the engine ECU (not shown) is supplied to the terminals 102*a* and 102*b* of the fuel injector 102, the fuel injector 102 is set in a valve-open state (or in an ON state) so that a high-pressure fuel is injected into the intake port 96 by the fuel injector 102. The high-pressure fuel is always delivered to the fuel injector 102 during an operation of the engine. In the cylinder head 92, the fuel injector 102 is provided for one of the plurality of cylinders of the engine, and other fuel injectors are also provided for the other cylinders of the engine.

The cylinder head cover 90 of this embodiment is made of a heat resisting resin material. The cylinder head cover 90 is bolted to an upper portion of the cylinder head 92. A sealing material 104 between the cylinder head cover 90 and the cylinder head 92 is provided to ensure sealing of the cylinder head cover 90 and the cylinder head 92.

The cylinder head cover 90 includes a spring contact 106*a* and a spring contact 106*b* which are electrically connected to the terminal 102*a* and the terminal 102*b* of the fuel injector 102, respectively, when the cylinder head cover 90 and the cylinder head 92 are properly connected to each other. Each of the spring contacts 106*a* and 106*b* has a contact portion touching a corresponding one of the terminals 102*a* and 102*b*, and a spring portion pressing the contact portion onto the corresponding one of the terminals 102*a* and 102*b*.

Further, the cylinder head cover 90 includes a wiring portion 108 which has electric connections 108*a* for interconnecting the spring contacts 106*a* and 106*b* and terminals of a control-unit connector (not shown) on an end wall of the cylinder head cover 90. The wiring portion 108 is integrally formed within a wall of the cylinder head cover 90. In the wiring portion 108, the electric connections 108*a* are formed by printed wire patterns or embedded metal conductors.

Similarly to the control-unit connector 48 of FIG. 2, the control-unit connector of this embodiment is arranged on the end wall of the cylinder head cover 90, and includes a given number of terminals to which the engine ECU is electrically connected.

In the cylinder head cover 90 of the above-described embodiment, the electric connections between the electronic parts (including all the fuel injectors such as the fuel injector 102) and the engine ECU are made by the wiring portion 108. By using the cylinder head cover 90, the electric connections between the electronic parts and the engine ECU can be easily performed, and the use of a wiring harness having a complicated structure as in the conventional engine 10 of FIG. 1 can be eliminated.

Figure 6:
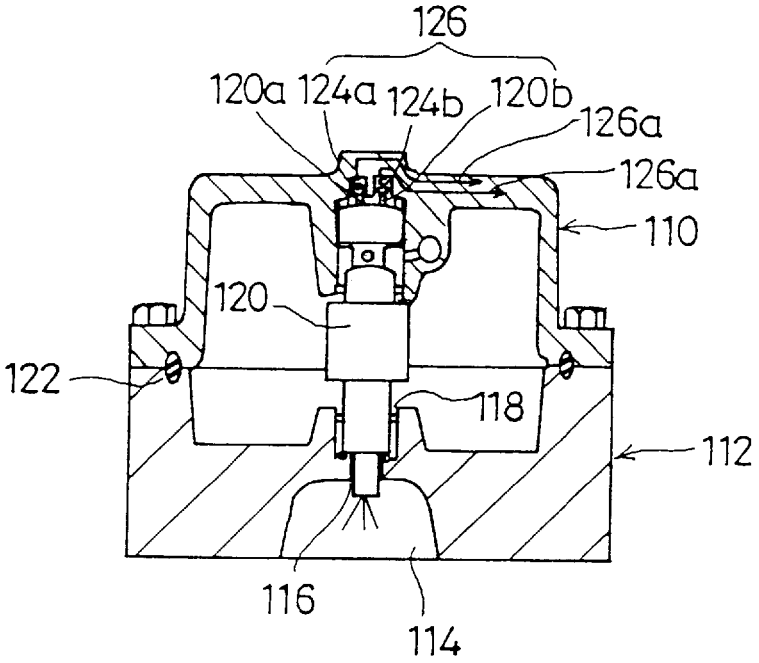
FIG. 6 is a cross-sectional view of a fourth embodiment of the cylinder head cover embodying the present invention.

FIG. 6 shows a fourth embodiment of the cylinder head cover embodying the present invention. In FIG. 6, a cross-section of a cylinder head cover 110 of this embodiment and a cylinder head 112 of an internal combustion engine is shown.

As shown in FIG. 6, the cylinder head 112 includes a combustion chamber 114 which is provided for one of a plurality of cylinders of the engine. The cylinder head 112 includes a through hole 116 which is open to the combustion chamber 114, and an opening 118 which is greater in diameter than the hole 116 and provided above the hole 116.

A fuel injector 120 having a leading edge projecting into the combustion chamber 114 is arranged on the opening 118 and the hole 116 of the cylinder head 110. The fuel injector 120 is a type of electronic fuel injection valve, and has an input terminal 120*a* and an input terminal 120*b*. When a drive signal from the engine ECU (not shown) is supplied to the terminals 120*a* and 120*b* of the fuel injector 120, the fuel injector 120 is set in a valve-open state (or in an ON state) so that a high-pressure fuel is injected into the combustion chamber 114 by the fuel injector 120. The high-pressure fuel is always delivered to the fuel injector 120 during an operation of the engine. In the cylinder head 112, the fuel injector 120 is provided for one of the plurality of cylinders of the engine, and other fuel injectors similar to the fuel injector 120 are provided for the other cylinders of the engine.

The cylinder head cover 110 of this embodiment is made of a heat resisting resin material. The cylinder head cover 110 is bolted to an upper portion of the cylinder head 112. A sealing material 122 between the cylinder head cover 110 and the cylinder head 112 is provided to ensure sealing of the cylinder head cover 110 and the cylinder head 112.

The cylinder head cover 110 includes a spring contact 124*a* and a spring contact 124*b* which are electrically connected to the terminal 120*a* and the terminal 120*b* of the fuel injector 120, respectively, when the cylinder head cover 110 and the cylinder head 112 are properly connected to each other. Each of the spring contacts 124*a* and 124*b* has a contact portion touching a corresponding one of the terminals 120*a* and 120*b*, and a spring portion pressing the contact portion onto the corresponding one of the terminals 120*a* and 120*b*.

Further, the cylinder head cover 110 includes a wiring portion 126 which has electric connections 126*a* for interconnecting the spring contacts 120*a* and 120*b* and terminals of a control-unit connector (not shown) on an end wall of the cylinder head cover 110. The wiring portion 126 is integrally formed within a wall of the cylinder head cover 110. In the wiring portion 126, the electric connections 126*a* are formed by printed wire patterns or embedded metal conductors.

Similarly to the control-unit connector 48 of FIG. 2, the control-unit connector of this embodiment is arranged on the end wall of the cylinder head cover 110, and includes a given number of terminals to which the engine ECU is electrically connected.

In the cylinder head cover 110 of the above-described embodiment, the electric connections between the electronic parts (including all the fuel injectors such as the fuel injector 120) and the engine ECU are made by the wiring portion 126. By using the cylinder head cover 110, the electric connections between the electronic parts and the engine ECU can be easily performed, and the use of a wiring harness having a complicated structure as in the conventional engine 10 of FIG. 1 can be eliminated.

Figure 7:
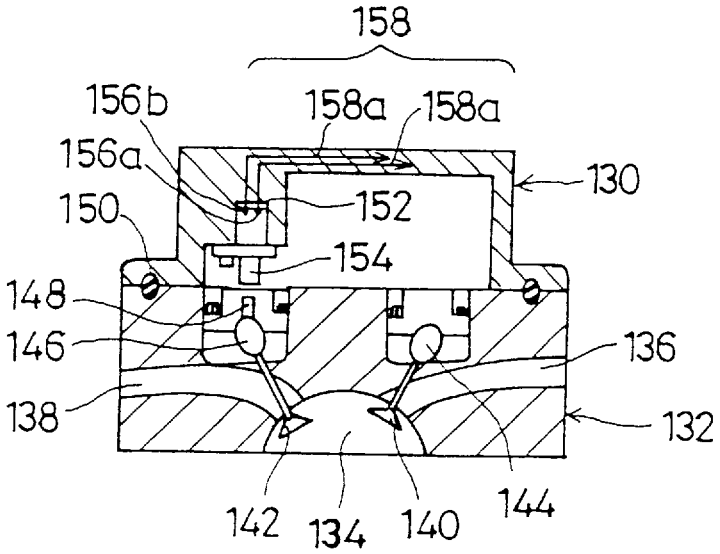
FIG. 7 is a cross-sectional view of a fifth embodiment of the cylinder head cover embodying the present invention.

FIG. 7 shows a fifth embodiment of the cylinder head cover embodying the present invention. In FIG. 7, a cross-section of a cylinder head cover 130 of this embodiment and a cylinder head 132 of an internal combustion engine is shown. The internal combustion engine to which the cylinder head cover 130 of this embodiment is applied includes a variable valve timing (VVT) mechanism.

As shown in FIG. 7, the cylinder head 132 includes a combustion chamber 134 which is provided for one of a plurality of cylinders of the engine. The cylinder head 132 includes an intake port 136 and an exhaust port 138 which are open to the combustion chamber 134. An intake valve 140 is arranged at the intake port 136, and an exhaust valve 142 is arranged at the exhaust port 138. Further, the cylinder head 132 includes a cam unit 144 which is rotated to move the intake valve 140, and a cam unit 146 which is rotated to move the exhaust valve 142. The cam unit 146 includes a projection 148 which is rotated in conjunction with the cam unit 146.

The cylinder head cover 130 of this embodiment is made of a heat resisting resin material. The cylinder head cover 130 is bolted to an upper portion of the cylinder head 132. A sealing material 150 between the cylinder head cover 130 and the cylinder head 132 is provided to ensure sealing of the cylinder head cover 130 and the cylinder head 132.

The cylinder head cover 130 includes a sensor fitting portion 152 in which an electromagnetic pickup 154 is fitted. The sensor fitting portion 152 includes a contact 156*a* and a contact 156*b* which are both electrically connected to the electromagnetic pickup 154.

The cylinder head cover 130 and the cylinder head 132 are properly connected to each other, and the electromagnetic pickup 154 and the projection 148 constitute a cam angle sensor of the VVT mechanism. In the cam angle sensor, the projection 148 passes a sensing portion of the electromagnetic pickup 154 each time a rotating angle of the cam unit 146 is equal to a reference angle. Each time the rotating angle of the cam unit 146 is equal to the reference angle, the electromagnetic pickup 154 outputs a pulse signal. By detecting a timing of the output of the pulse signal by the electromagnetic pickup 154, it is possible to detect whether the rotating angle of the cam unit 146 is equal to the reference angle.

Further, the cylinder head cover 130 includes a wiring portion 158 which has electric connections 158*a* for interconnecting the contacts 156*a* and 156*b* and terminals of a control-unit connector (not shown) on an end wall of the cylinder head cover 130. The wiring portion 158 is integrally formed within a wall of the cylinder head cover 130. In the wiring portion 158, the electric connections 158*a* are formed by printed wire patterns or embedded metal conductors.

Similarly to the control-unit connector 48 of FIG. 2, the control-unit connector of this embodiment is arranged on the end wall of the cylinder head cover 130, and includes a given number of terminals to which the engine ECU is electrically connected.

In the cylinder head cover 130 of the above-described embodiment, the electric connections between the electronic parts (including the electromagnetic pickup 154) and the engine ECU are made by the wiring portion 158. By using the cylinder head cover 130, the electric connections between the electronic parts and the engine ECU can be easily performed, and the use of a wiring harness having a complicated structure as in the conventional engine 10 of FIG. 1 can be eliminated.

Figure 8:
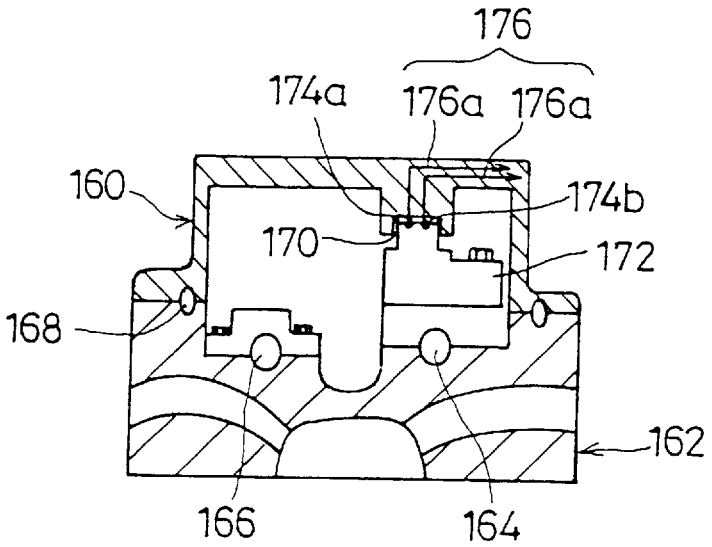
FIG. 8 is a cross-sectional view of a sixth embodiment of the cylinder head cover embodying the present invention.

FIG. 8 shows a sixth embodiment of the cylinder head cover embodying the present invention. In FIG. 8, a cross-section of a cylinder head cover 160 of this embodiment and a cylinder head 162 of an internal combustion engine is shown. The internal combustion engine to which the cylinder head cover 160 of this embodiment is applied includes a variable valve timing (VVT) mechanism.

As shown in FIG. 8, the cylinder head 162 includes a cam shaft 164 which is rotated to move an intake valve (not shown), and a cam shaft 166 which is rotated to move an exhaust valve (not shown). The cam shafts 164 and 166 are secured to the cylinder head 162. The cam shafts 164 and 166 are connected to a crankshaft (not shown) of the engine, and the cam shafts 164 and 166 are rotated in synchronism with the rotation of the crankshaft.

Further, the cylinder head 162 includes a phase modifying unit (not shown) which modifies a phase difference between the crankshaft and the cam shaft 164. By controlling the pressure of oil supplied to the phase modifying unit and suitably modifying the phase difference between the crankshaft and the cam shaft 164, it is possible to change the timing of setting the intake valve in one of an opened condition and a closed condition by the rotation of the cam shaft 164.

The cylinder head cover 160 of this embodiment is made of a heat resisting resin material. The cylinder head cover 160 is bolted to an upper portion of the cylinder head 162. A sealing material 168 between the cylinder head cover 160 and the cylinder head 162 is provided to ensure sealing of the cylinder head cover 160 and the cylinder head 162.

The cylinder head cover 160 includes a sensor fitting portion 170 in which an oil pressure control valve 172 is fitted. The oil pressure control valve 172 is one of the components of the VVT mechanism. The sensor fitting portion 170 includes a contact 174*a* and a contact 174*b* which are both electrically connected to the oil pressure control valve 172.

During an operation of the engine, oil under a predetermined pressure is supplied to the oil pressure control valve 172. The oil pressure control valve 172 is operated in accordance with a drive signal supplied from the engine ECU through the contacts 174*a* and 174*b*, and the oil pressure control valve 172 supplies the oil pressure to the above phase modifying unit in accordance with the opened/closed condition of the oil pressure control valve 172. Therefore, by supplying the drive signal to the oil pressure control valve 172 through the contacts 174*a* and 174*b*, it is possible to change the timing of setting the intake valve in one of the opened condition and the closed condition by the rotation of the cam shaft 164.

Further, the cylinder head cover 160 includes a wiring portion 176 which has electric connections 176*a* for interconnecting the contacts 176*a* and 176*b* and terminals of a control-unit connector (not shown) on an end wall of the cylinder head cover 160. The wiring portion 176 is integrally formed within a wall of the cylinder head cover 160. In the wiring portion 176, the electric connections 176*a* are formed by printed wire patterns or embedded metal conductors.

Similarly to the control-unit connector 48 of FIG. 2, the control-unit connector of this embodiment is arranged on the end wall of the cylinder head cover 160, and includes a given number of terminals to which the engine ECU is electrically connected.

In the cylinder head cover 160 of the above-described embodiment, the electric connections between the electronic parts (including the oil pressure control valve 172) and the engine ECU are made by the wiring portion 176. By using the cylinder head cover 160, the electric connections between the electronic parts and the engine ECU can be easily performed, and the use of a wiring harness having a complicated structure as in the conventional engine 10 of FIG. 1 can be eliminated.

Figure 9:
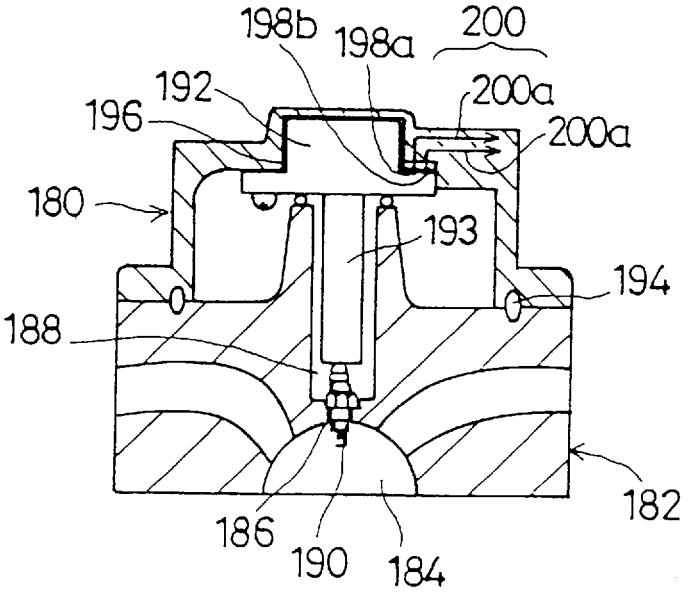
FIG. 9 is a cross-sectional view of a seventh embodiment of the cylinder head cover.

FIG. 9 shows a seventh embodiment of the cylinder head cover embodying the present invention. In FIG. 9, a cross-section of a cylinder head cover 180 of this embodiment and a cylinder head 182 of an internal combustion engine is shown. The internal combustion engine to which the cylinder head cover 180 of this embodiment is applied includes an ignition-coil ignitor.

As shown in FIG. 9, the cylinder head 182 includes a combustion chamber 184 which is provided for one of a plurality of cylinders of the engine. The cylinder head 182 includes a through hole 186 which is open to the combustion chamber 184, and an opening 188 which is greater in diameter than the hole 186 and provided above the hole 186.

A spark plug 190 having a leading edge projecting into the combustion chamber 184 is secured to the hole 186 of the cylinder head 182. An ignition-coil ignitor 192 is arranged on a bottom surface of the cylinder head cover 180 and located to the top of the opening 188. The ignition-coil ignitor 192 is a type of ignitor which is formed as a single electronic part including an ignition coil and an ignitor in combination. The ignition-coil ignitor 192 is electrically connected to the spark plug 190 by a conductor member 193 which is arranged within the opening 188.

The cylinder head cover 180 of this embodiment is made of a heat resisting resin material. The cylinder head cover 180 is bolted to an upper portion of the cylinder head 182. A sealing material 194 between the cylinder head cover 180 and the cylinder head 182 is provided to ensure sealing of the cylinder head cover 180 and the cylinder head 182.

The cylinder head cover 180 includes a fitting portion 196 in which the ignition-coil ignitor 192 is fitted. The fitting portion 196 includes a contact 198*a* and a contact 198*b* which are electrically connected to the ignition-coil ignitor 192 when the cylinder head cover 180 and the cylinder head 182 are properly connected to each other.

The ignition-coil ignitor 192 supplies a secondary voltage to the spark plug 190 in accordance with a drive signal supplied from the engine ECU through the contacts 198*a* and 198*b*. By supplying the drive signal to the ignition-coil ignitor 192 through the contacts 198*a* and 198*b*, it is possible to carry out the ignition control of the engine.

Further, the cylinder head cover 180 includes a wiring portion 200 which has electric connections 200*a* for interconnecting the contacts 198*a* and 198*b* and terminals of a control-unit connector (not shown) on an end wall of the cylinder head cover 180. The wiring portion 200 is integrally formed within a wall of the cylinder head cover 180. In the wiring portion 200, the electric connections 200*a* are formed by printed wire patterns or embedded metal conductors.

Similarly to the control-unit connector 48 of FIG. 2, the control-unit connector of this embodiment is arranged on the end wall of the cylinder head cover 180, and includes a given number of terminals to which the engine ECU is electrically connected.

In the cylinder head cover 180 of the above-described embodiment, the electric connections between the electronic parts (including the ignition-coil ignitor 192) and the engine ECU are made by the wiring portion 200. By using the cylinder head cover 180, the electric connections between the electronic parts and the engine ECU can be easily performed, and the use of a wiring harness having a complicated structure as in the conventional engine 10 of FIG. 1 can be eliminated.

Figure 10:
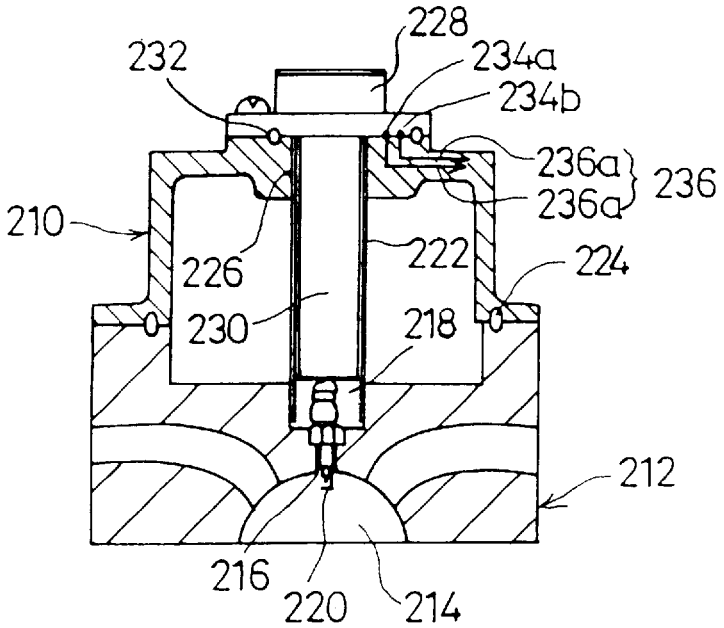
FIG. 10 is a cross-sectional view of an eighth embodiment of the cylinder head cover embodying the present invention.

FIG. 10 shows an eighth embodiment of the cylinder head cover embodying the present invention. In FIG. 10, a cross-section of a cylinder head cover 210 of this embodiment and a cylinder head 212 of an internal combustion engine is shown. The internal combustion engine to which the cylinder head cover 210 of this embodiment is applied includes an ignition-coil ignitor.

As shown in FIG. 10, the cylinder head 212 includes a combustion chamber 214 which is provided for one of a plurality of cylinders of the engine. The cylinder head 212 includes a through hole 216 which is open to the combustion chamber 214, and an opening 218 which is greater in diameter than the hole 216 and provided above the hole 216.

A spark plug 220 having a leading edge projecting into the combustion chamber 214 is secured to the hole 216 of the cylinder head 212. A cylindrical member 222 encircling the spark plug 220 is arranged above the opening 218 of the cylinder head 212, and the bottom of the cylindrical member 222 is fitted into the opening 218.

The cylinder head cover 210 of this embodiment is made of a heat resisting resin material. The cylinder head cover 210 is bolted to an upper portion of the cylinder head 212. A sealing material 224 between the cylinder head cover 210 and the cylinder head 212 is provided to ensure sealing of the cylinder head cover 210 and the cylinder head 212.

The cylinder head cover 210 includes a through hole 226 to which an upper portion of the cylindrical member 222 is fitted. An ignition-coil ignitor 228 is arranged on a top surface of the cylinder head cover 210. A conductor member 230 is inserted into the cylindrical member 222. The ignition-coil ignitor 228 is electrically connected to the spark plug 216 by the conductor member 230.

A sealing material 232 between the ignition-coil ignitor 228 and the cylinder head cover 210 is provided to ensure sealing of the ignition-coil ignitor 228 and the cylinder head cover 210.

Further, the cylinder head cover 210 includes a contact 234*a* and a contact 234*b*, on the top surface thereof, which are electrically connected to the ignition-coil ignitor 228 when the ignition-coil ignitor 228 and the cylinder head cover 210 are properly connected to each other.

The ignition-coil ignitor 228 supplies a secondary voltage to the spark plug 220 in accordance with a drive signal supplied from the engine ECU through the contacts 234*a* and 234*b*. By supplying the drive signal to the ignition-coil ignitor 228 through the contacts 234*a* and 234*b*, it is possible to carry out the ignition control of the engine.

Further, the cylinder head cover 210 includes a wiring portion 236 which has electric connections 236*a* for interconnecting the contacts 234*a* and 234*b* and terminals of a control-unit connector (not shown) on an end wall of the cylinder head cover 210. The wiring portion 236 is integrally formed within a wall of the cylinder head cover 210. In the wiring portion 236, the electric connections 236*a* are formed by printed wire patterns or embedded metal conductors.

Similarly to the control-unit connector 48 of FIG. 2, the control-unit connector of this embodiment is arranged on the end wall of the cylinder head cover 210, and includes a given number of terminals to which the engine ECU is electrically connected.

In the cylinder head cover 210 of the above-described embodiment, the electric connections between the electronic parts (including the ignition-coil ignitor 228) and the engine ECU are made by the wiring portion 236. By using the cylinder head cover 210, the electric connections between the electronic parts and the engine ECU can be easily performed, and the use of a wiring harness having a complicated structure as in the conventional engine 10 of FIG. 1 can be eliminated.

Further, in the cylinder head cover 210 of the above-described embodiment, the ignition-coil ignitor 228 and the spark plug 216 can be easily removed from the cylinder head 212 without removing the cylinder head cover 210 from the cylinder head 212. Therefore, it is possible for the cylinder head cover of the present embodiment to provide a good operability of the repair or maintenance of the vehicle.

Figure 11:
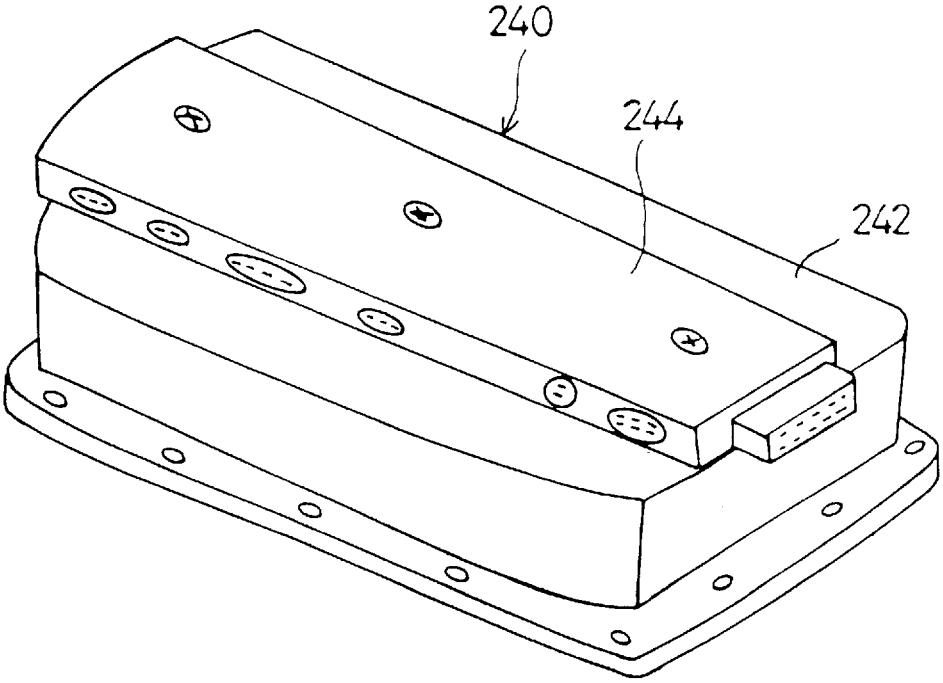
FIG. 11 is a perspective view of a ninth embodiment of the cylinder head cover embodying the present invention.
Figure 12:
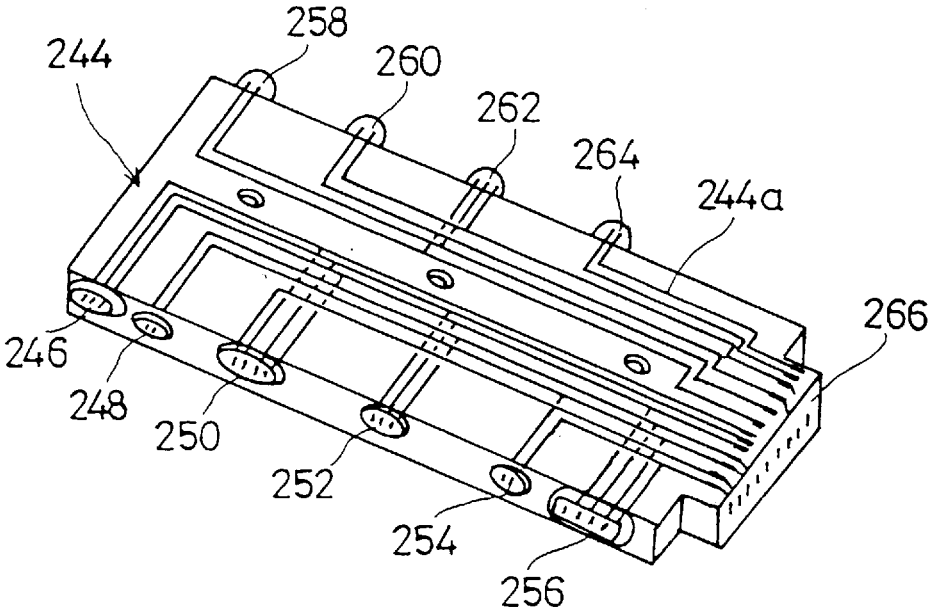
FIG. 12 is a perspective view of a wiring portion of the cylinder head cover of FIG. 11.

FIGS. 11 and 12 show a ninth embodiment of the cylinder head cover embodying the present invention. FIG. 11 is a perspective view of a cylinder head cover 240 of this embodiment. As shown in FIG. 11, the cylinder head cover 240 includes a cylinder head cover body 242 and a wiring portion 244. The cylinder head cover body 242 is made of an iron alloy or a steel alloy through casting. The wiring portion 244 is made of a heat resisting resin material. The wiring portion 244 is bolted to an upper portion of the cylinder head cover body 242.

FIG. 12 shows the wiring portion 244 of the cylinder head cover of FIG. 11. As shown in FIG.12, the wiring portion 244 includes a plurality of connectors 246 through 264 which are arranged on side walls of the wiring portion 244. A plurality of electronic parts which are externally arranged on an internal combustion engine are electrically connected to the connectors 246 through 264. Each of the connectors 246 through 264 includes a given number of contacts to which a corresponding one of the electronic parts is electrically connected.

The wiring portion 244 includes a control-unit connector 266 which is arranged on an end wall of the wiring portion 244. The control-unit connector 266 has a given number of terminals to which the engine ECU is electrically connected.

The wiring portion 244 has a bottom surface (not shown) on which a plurality of contacts are internally formed. Electronic parts which are internally arranged on the engine are electrically connected to the contacts of the bottom surface of the wiring portion 244.

The cylinder head cover body 242 has a plurality of openings on the upper surface of the body 242 at corresponding locations of the contacts of the bottom surface of the wiring portion 244. Therefore, even if the wiring portion 244 is secured to the upper portion of the cylinder head cover body 242, the internal contacts of the wiring portion 244 project into the inside space of the engine.

As shown in FIG. 12, the wiring portion 244 has electric connections 244*a* for interconnecting the contacts of the connectors 246 through 264, the internal contacts of the bottom surface of the wiring portion 244, and the terminals of the control-unit connector 266. The electric connections 244*a* of the wiring portion 244 are formed by a multiple-layer printed circuit board or multiple metal-conductor-embedded layers.

In the cylinder head cover 240 of the above-described embodiment, the electric connections between the externally arranged electronic parts, the internally arranged electronic parts and the engine ECU are made by the wiring portion 244. By using the cylinder head cover 240, the electric connections between the electronic parts and the engine ECU can be easily performed, and the use of a wiring harness having a complicated structure as in the conventional engine 10 of FIG. 1 can be eliminated.

Figure 13:
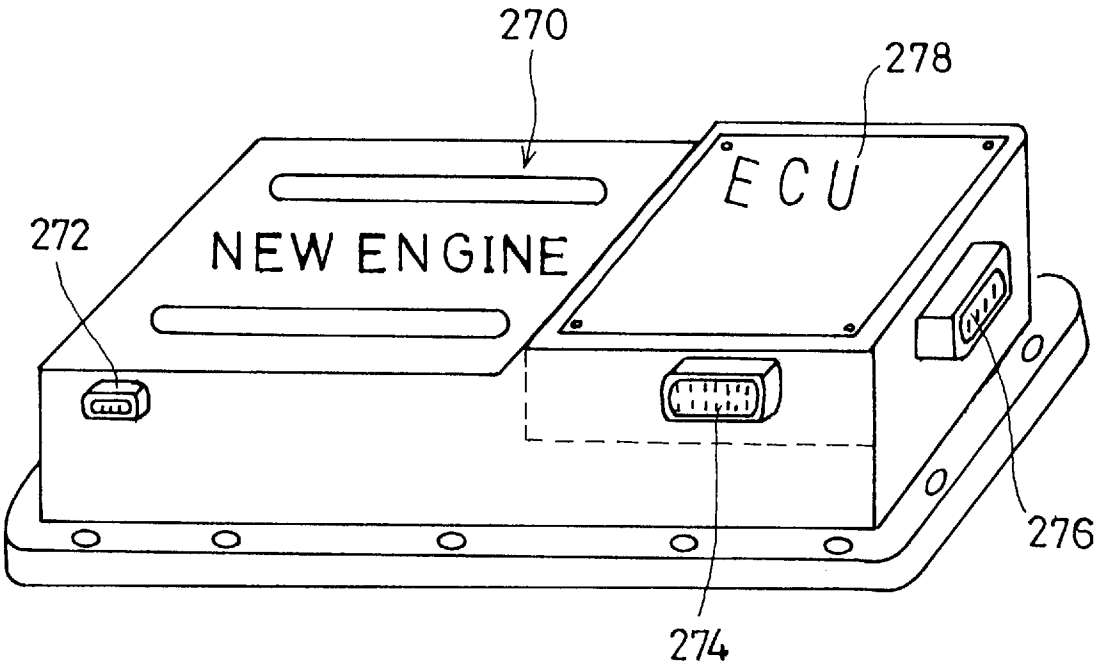
FIG. 13 is a perspective view of a tenth embodiment of the cylinder head cover embodying the present invention.

FIG. 13 is a perspective view of a tenth embodiment of the cylinder head cover embodying the present invention. In the present embodiment, a cylinder head cover 270 is made of a heat resisting resin material. The cylinder head cover 270 includes a connector 272, a connector 274 and a connector 276 which are arranged on a side wall and an end wall of the cylinder head cover 270. Each of the connectors 272, 274 and 276 includes a given number of contacts to which externally arranged electronic parts of the engine are electrically connected. The cylinder head cover 270 includes a plurality of internal contacts which are internally arranged. Internally arranged electronic parts of the engine are electrically connected to the internal contacts of the cylinder head cover 270. Further, an engine ECU 278 which is the electronic control unit of the engine is built in the cylinder head cover. The engine ECU 278 includes a given number of terminals.

Similarly to the previous embodiments, the cylinder head cover 270 of the present embodiment further includes a wiring portion (not shown) having electric connections for electrically interconnecting the external contacts of the connectors 272, 274 and 276, the internal contacts, and the terminals of the engine ECU 278. The wiring portion is integrally formed with a wall of the cylinder head cover 270.

Accordingly, in the cylinder head cover 270 of the present embodiment, the electric connections between the externally arranged electronic parts, the internally arranged electronic parts and the engine ECU are made by the wiring portion. By using the cylinder head cover 270, the electric connections between the electronic parts and the engine ECU can be easily performed, and the use of a wiring harness having a complicated structure as in the conventional engine 10 of FIG. 1 can be eliminated.

Further, the present invention is not limited to the above-described embodiments, and variations and modifications may be made without departing from the scope of the present invention.

What is claimed is:

1. A cylinder head cover for an internal combustion engine, comprising:

a plurality of contacts to which electronic parts of the engine are electrically connected;

a control-unit connector having terminals to which an electronic control unit of the engine is electrically connected; and a wiring portion having electric connections for interconnecting the contacts and the terminals of the control-unit connector, said wiring portion being integral with a wall of the cylinder head cover.

2. The cylinder head cover according to claim 1, wherein said contacts include contacts of an external connector externally arranged on the cylinder head cover and contacts of an electronic-part fitting portion internally arranged in the cylinder head cover.

3. The cylinder head cover according to claim 1, wherein said control-unit connector is externally arranged on the cylinder head cover.

4. The cylinder head cover according to claim 1, wherein said contacts include a spring contact to which an internally arranged sensor is electrically connected, the sensor being one of the electronic parts and arranged between the cylinder head cover and a cylinder head of the engine, the sensor outputting a signal to the electronic control unit through the wiring portion, said spring contact having a contact portion touching the sensor and a spring portion pressing the contact portion onto the sensor.

5. The cylinder head cover according to claim 1, wherein said contacts include a spring contact to which a fuel injector is electrically connected, said fuel injector being one of the electronic parts and arranged between the cylinder head cover and a cylinder head of the engine, the fuel injector having a leading edge projecting into an intake port of the cylinder head, the electronic control unit supplying a signal to the fuel injector through the wiring portion.

6. The cylinder head cover according to claim 1, wherein said contacts include a spring contact to which a fuel injector is electrically connected, said fuel injector being one of the electronic parts and arranged between the cylinder head cover and a cylinder head of the engine, said fuel injector having a leading edge projecting into a combustion chamber of the cylinder head, the electronic control unit supplying a signal to the fuel injector through the wiring portion.

7. The cylinder head cover according to claim 1, wherein said contacts include a contact to which an electromagnetic pickup is electrically connected, said pickup being one of the electronic parts and arranged between the cylinder head cover and a cylinder head of the engine, said pickup outputting a signal to the electronic control unit through the wiring portion.

8. The cylinder head cover according to claim 1, wherein said contacts include a contact to which an oil control valve is electrically connected, said valve being one of the electronic parts and arranged between the cylinder head cover and a cylinder head of the engine, the electronic control unit supplying a signal to the valve through the wiring portion.

9. The cylinder head cover according to claim 1, wherein said contacts comprise a contact to which an ignitor is electrically connected, said ignitor being one of the electronic parts and arranged on a bottom surface of the cylinder head cover, the electronic control unit supplying a signal to the ignitor through the wiring portion.

10. The cylinder head cover according to claim 1, wherein said contacts comprise a contact to which an ignitor is electrically connected, said ignitor being one of the electronic parts and arranged on a top surface of the cylinder head cover, the electronic control unit supplying a signal to the ignitor through the wiring portion.

* * * * *